United States Patent [19]

Giannuzzi et al.

[11] Patent Number: 4,503,788

[45] Date of Patent: Mar. 12, 1985

[54] TRANSLAMINAR STITCHING APPARATUS FOR COMPOSITE AIRFRAME PART ASSEMBLY

[75] Inventors: Ottavio Giannuzzi, Baldwin; Ronald C. Braun, West Islip, both of N.Y.

[73] Assignee: Grumman Aerospace Corporation, Bethpage, N.Y.

[21] Appl. No.: 423,485

[22] Filed: Sep. 24, 1982

[51] Int. Cl.[3] ..... D05B 21/00

[52] U.S. Cl. ..... 112/121.12; 112/121.14

[58] Field of Search ..... 112/121.12, 121.14, 112/262.1, 89, 131, 235, 240, 121.15

[56] References Cited

U.S. PATENT DOCUMENTS

| | | | |
|---|---|---|---|
| 1,625,616 | 4/1927 | Long | 112/240 |
| 2,477,040 | 7/1949 | Brown et al. | 219/47 |
| 2,837,046 | 6/1958 | Carson et al. | 112/118 |
| 2,864,327 | 12/1958 | Cole et al. | 112/2 |
| 3,180,292 | 4/1965 | Allen | 112/121.14 |
| 3,296,990 | 1/1967 | Simjian | 112/262 |
| 3,344,759 | 10/1967 | Palmer | 112/2 |
| 3,345,964 | 10/1967 | Palmer | 112/2 |
| 3,385,245 | 5/1968 | Ramsey et al. | 112/2 |
| 3,450,076 | 6/1969 | Bender | 112/121.12 X |
| 3,492,552 | 1/1970 | Usami et al. | 112/121.12 X |
| 3,750,601 | 8/1973 | Lee | 112/121.12 |
| 3,759,199 | 9/1973 | Lee | 112/121.12 |
| 3,973,859 | 8/1976 | Huber et al. | 408/12 |
| 4,077,340 | 3/1978 | Braun et al. | 112/89 X |
| 4,080,915 | 3/1978 | Bompard et al. | 112/262.1 X |
| 4,100,865 | 7/1978 | Landau, Jr. et al. | 112/121.11 |
| 4,135,459 | 1/1979 | Manabe et al. | 112/121.12 |
| 4,187,794 | 2/1980 | Ross et al. | 112/308 |
| 4,226,199 | 10/1980 | Adams | 112/308 |
| 4,273,059 | 6/1981 | Kamal | 112/121.14 |
| 4,299,871 | 11/1981 | Forsch | 428/104 |
| 4,388,883 | 6/1983 | Hirota et al. | 112/121.12 |
| 4,403,559 | 9/1983 | Hirose | 112/121.12 |

FOREIGN PATENT DOCUMENTS

| | | |
|---|---|---|
| 748857 | 9/1970 | Belgium . |
| 2544165 | 10/1975 | Fed. Rep. of Germany . |
| 1083745 | 7/1953 | France . |
| 1115170 | 10/1966 | United Kingdom . |

*Primary Examiner*—Peter Nerbun

*Attorney, Agent, or Firm*—Morgan, Finnegan, Pine, Foley & Lee

[57] ABSTRACT

A translaminar stitching module is disclosed for stitching complex airframe details comprised of composite materials. The stitching module is self-digitizing, microprocessor controlled, and has six degrees of motion which allow the module to stitch along straight, bowed, twisted and highly contoured paths. During the stitching operation positioning is controlled by a microprocessor by controlling movement along five of the module's six axes through the use of encoder feedback. Upon receipt of the encoded data a microprocessor interpolates between selected coordinate point inputs and inserts the required stitch pitch for proper movement along the stitching path.

16 Claims, 12 Drawing Figures

TRANSLAMINAR STITCHING APPARATUS FOR COMPOSITE AIRFRAME PART ASSEMBLY

BACKGROUND OF THE INVENTION

Since airplanes were first constructed there has been a need to provide fasteners for the application of skin coverings to load carrying structures that would accommodate the shear tensile loading between a skin and its substructure. Over time the airplane industry has come to rely on mechanical fasteners to satisfy this need, particularly since evolution of airplane design and construction has resulted in airplanes manufactured almost entirely from metal.

Recent developments in aircraft design have produced a new genertion of aircraft constructed with as much as fifty percent or more advanced composite materials such as graphite/epoxy. Because of the complexity of the designs of these aircraft, today's aircraft manufacturers have come to rely on automation to economically manufacture and assemble their advanced composite parts. To date, however, a suitable means for automating the assembly of these parts has yet to be developed, causing manufacturers to continue to rely on mechanical fasteners for fastening composite structures to substructures. The use of mechanical fasteners, however, causes the cost of final assembly to be increased because of their special drilling and reinforcement requirements, and because of the need for such fasteners to be made from more expensive materials to avoid serious corrosion problems in service.

SUMMARY OF THE INVENTION

Accordingly, it is a principal object of the present invention to provide an apparatus for stitching together composite airframe parts as an alternative to the use of other fastening techniques. Another object of the present invention is to provide a stitching apparatus that can stitch along the straight, bowed, twisted and highly contoured paths which are present in advanced composite structures. A further object of the present invention is to provide a microprocessor controlled stitching apparatus having six axes of motion to achieve the flexibility of motion required for stitching along the straight and complexly contoured paths present in advanced composite structures.

According to the present invention, a translaminar stitching module is provided which includes a stitching assembly housing a stitching mechanism, and a rack assembly used to support composite workpieces during stitching. The module is capable of stitching composite materials in both circumferential and/or longitudinal directions. For this purpose, the module is provided with six axes of movement, three translational axes and three rotational axes. The translational axes include an X axis of translation parallel to the composite workpieces being stitched, a Y axis of translation perpendicular to the composite workpieces, and a Z axis of translation perpendicular to the floor. The rotational axes include an alpha axis of rotation around an axis parallel to the Y axis, a beta axis of rotation around an axis parallel to the Z axis, and a gamma axis of rotation around an axis parallel to the X axis.

The X, Y, Z, alpha and gamma axes are controlled by a microprocessor-based control system using encoder feedback for position control. One encoder is provided for each of the five axes.

Movement along the Y, Z and alpha axes is implemented by translating and/or rotating various sub-assemblies of the stitching assembly, while movement along the X and gamma axes is implemented by translating and/or rotating the rack assembly.

The Z axis normally operates as a single servo controlled axis; however, it also functions as a split axis during stitching to enable the stitching assembly to avoid any obstructions which may be present on a workpiece.

The beta axis is a positional rotation axis. Motion along this axis can be implemented by rotating anyone of three sub-assemblies of the stitching assembly used directly in the stitching operation. Movement of each of these assemblies is also microprocessor controlled. However, unlike the other axes, positioning of the assemblies is sensed by the microprocessor through a series of photo-optical position switches.

The stitching module is also provided with a number of auxiliary mechanisms which allow it to access and stitch deep structure on workpieces, to exert pressure on workpieces to achieve tight stitch formation, to self-digitize for programming new stitch paths for new workpieces, and to heat workpieces to aid needle penetration for easier stitching.

DESCRIPTION OF THE PREFERRED EMBODIMENTS

Figure 1:
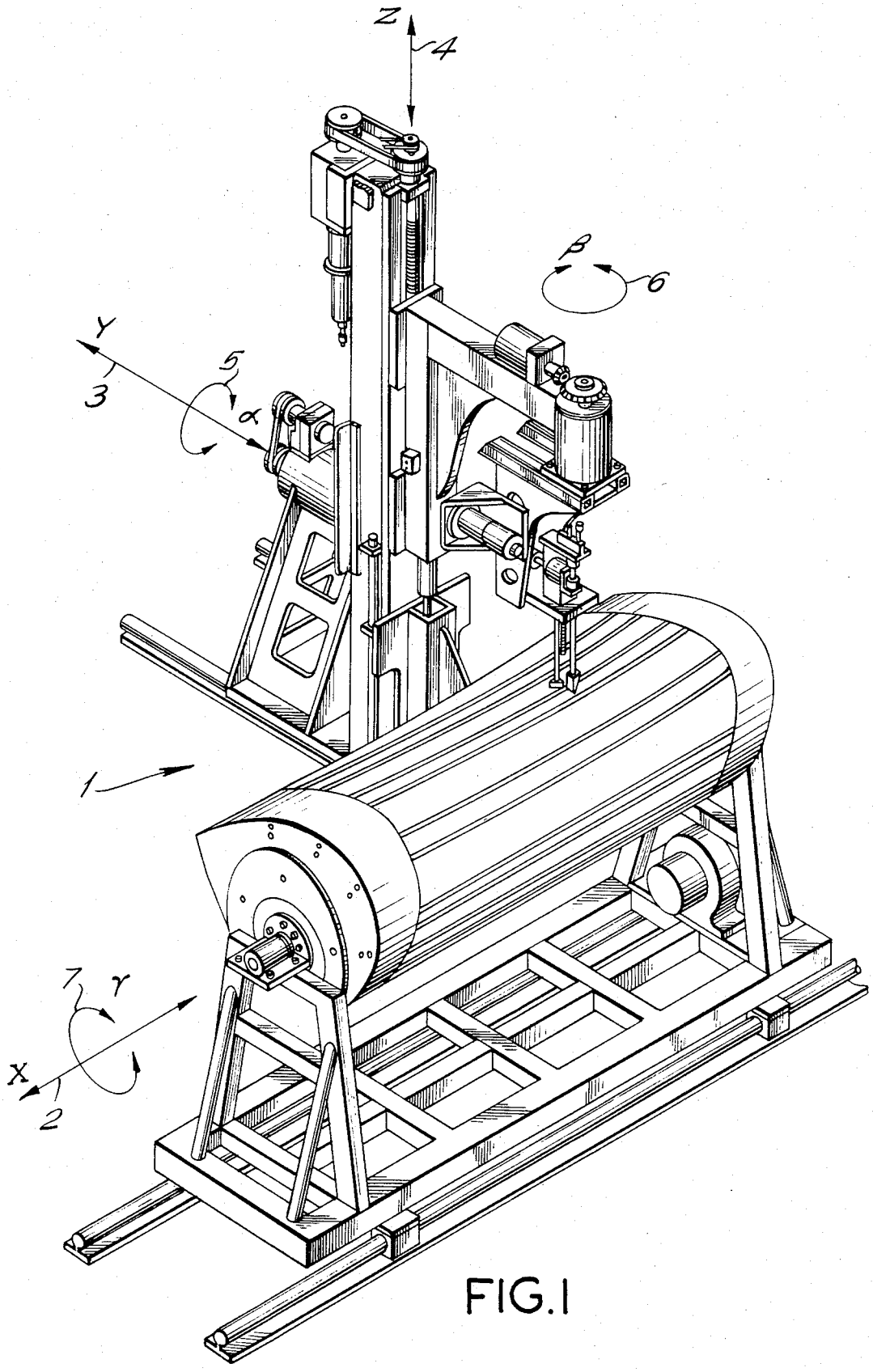
FIG. 1 is an isometric view of the stitching module showing its six axes of motion.

The stitching module of the present invention is a translaminar multi-axis stitcher that can move in both circumferential and/or longitudinal directions for stitching linear and curvilinear paths. FIG. 1 shows stitching module 1 and the six axes of motion used by the stitching module for circumferential and or longitudinal motion. These six axes include three translational axes and three rotational axes as follows: an X axis of translation 2 parallel to the composite workpieces being stitched, a Y axis of translation 3 perpendicular to the workpieces, a Z axis of translation 4 perpendicular to the floor, an alpha axis of rotation 5 around an axis parallel to the Y axis 3, a beta axis of rotation 6 around an axis parallel to the Z axis 4 and a gamma axis of rotation 7 around an axis parallel to the X axis 2.

Referring to FIGS. *2a, 2b* and 3, the stitching module incorporates a commercially available stitching machine, a Landis model 88 single thread chain stitch machine, for the actual stitching function. Two major subassemblies of the Landis machine are used. These include a stitching head assembly 8, containing a needle 9 and its associated drive shafts and cams, and a stitching horn assembly 10, containing a twirler mechanism for wrapping thread around needle 9.

The stitching head assembly is mounted on a support structure 11 which is driven by an AC motor 12. For movement along the beta axis during stitching the stitching head assembly is rotated to one of four positions through rotation of the support structure. These positions are marked by photo-optical switches 13 positioned at 90° intervals along the beta axis. Motor 12 is activated by a microprocessor based controller 14 (FIG. 3) through a typical motor control logic circuit 15. The photo-optical switches sense the position of the stitching head at any given time, and feed this information back to the controller to allow it to position the stitching head during stitching.

During stitching, stitching horn assembly 10 normally operates in conjunction with stitching head assembly 8. However, it can be rotated independently when necessary. Horn assembly 10 is rotated by a DC motor 16, and can be rotated to any of one of four distinct positions. The positions are also marked by photo-optical position switches 17 positioned at 90° intervals. Motor 16 is also activated by controller 14 through motor control logic 15, while position switches 17 also feed back positional information to controller 14 to allow it to position stitching horn 10 during stitching.

The horn assembly and its motor are mounted on a support structure called a horn yoke assembly 18. This assembly is, in turn, rotated by an AC motor 19, and can be rotated to one of four positions. These positions are also marked by photo-optical position switches 20 positioned at 90° intervals. Like motor 16, motor 19 is also activated by controller 14 through motor control logic 15, while position switches 20 also feed back positional information to controller 14 to allow it to position horn yoke 18 during stitching.

The foregoing rotational arrangement provides stitching head assembly 8 and stitching horn assembly 10 with a high degree of flexibility in their movement along the beta axis. Each assembly can be rapidly moved to one of four positions, thereby giving the stitching module the capability of changing its direction of stitching in a minimum amount of time. Thus, stitching module 1 can readily stitch in any of four directions (plus or minus X and plus or minus Y), and yet quickly turn around and stitch in a return direction in adjacent paths. This minimizes the time required at the end of each stitching run to locate the system for the next stitching run.

Stitching head 8, support 11 and motor 12 are all supported by an upper yoke assembly 21, while stitching horn 10, motor 16 and horn yoke 18 are all supported by a lower yoke assembly 22. Acting together upper yoke assembly 21 and lower yoke assembly 22 form a complete yoke assembly 23 which is slidably mounted on a dove tail slide drive assembly 24 for translation along the Z axis.

Mounted on top of this slide drive assembly is a Z axis drive assembly 25 which translates yoke assembly 23, and in turn stitching head 8 and stitching horn 10 along the Z axis. For this purpose a DC servo motor 26 and gear box 26' turn an acme screw 27, best seen in FIG. *4a*, by means of a belt 28 spanning two pulleys, one 29 attached to the output shaft of gear box 26, and a second 30 attached to an end of screw 27. As motor 26 and gear box 26' turn screw 27 either clockwise or counter clockwise, yoke 23, and thus the stitching head and horn, translate in either the plus or minus Z directions.

Servo motor 26 is part of a coordinate velocity servo loop used by the controller to implement and control velocity and position along the Z axis. Controller 14 uses a number of typical servo power amplifiers 31 to control the velocity of the servo motors used throughout the stitching module. For activation and velocity control of motor 26, controller 14 selects and energizes the particular servo power amplifier of amplifiers 31, which is connected to motor 26.

The distance which yoke 23 moves along the Z axis is measured by a Z axis encoder 32 mechanically linked to motor 26. The velocity information collected by this encoder is fed back to the controller to allow it to determine the position and speed of the stitching head with respect to a workpiece, and to adjust it accordingly. To protect yoke 23 from travelling too far in either direction along the Z axis over-travel limit switches 33 are provided.

Stitching module 1 is also capable of avoiding any obstructions which may be present on a given workpiece by splitting its Z axis. When an obstruction is approached, a cylinder 35 is extended by the controller activating a solenoid 36 through motor control logic 15. Extension of this cylinder causes the lower yoke 22, and in turn horn 10, to be lowered so as to avoid the obstruction. During this motion, the lower yoke slides down rails 37 which are secured to the sides of slide drive assembly 24. After the obstruction has been avoided, the solenoid is de-activated, causing cylinder 35 to retract, and the lower yoke and horn to slide up the rails. At this point the operation of the Z axis is resumed as a single servo controlled axis.

The positioning of cylinder 35 is sensed by two photo-optical position switches 38. One switch senses when the cylinder is retracted. The other senses when it is extended. This positional information is transmitted back to controller 14 for positioning control.

FIGS. *4a* and *4b* demonstrate movement of the stitching module along the alpha axis. This movement is implemented by an alpha axis drive assembly 40 which tilts yoke assembly 23, and in turn stitching head assembly 8 and stitching horn assembly 10. Because of the low speeds, power requiremements and positioning accuracy tolerance requirements for movement along this axis, the alpha drive utilizes a permanent magnet motor 41 which is controlled by the controller through a typical SCR motor control circuit 42. To tilt yoke 23, the shaft of this motor engages a curved sector gear 43, best seen in FIG. *4b*, mounted on the back of the yoke at the bottom. Operating in conjunction with the alpha drive is a swivel axis assembly 44 on which yoke 23 is rotatably mounted through a shaft and bearing assembly so as to allow it to tilt and move along the alpha axis. The design of sector gear 43 permits an alpha axis rotation of the stitching head and horn of plus or minus 15 degrees. Movement along the alpha axis is measured by an alpha axis encoder 45 which transmits this information to controller 14 for tilt control. To prevent excessive tilt over-travel limit switches 46 are also provided.

Swivel axis assembly 44 has a truss-like construction, and is mounted on top of a platform shaped base assembly 50. Movement of the stitching module along the Y axis is implemented by a Y axis drive assembly 51 which translates base 50, and in turn, stitching head 8 and stitching horn 10, in either the plus or minus Y directions. For this purpose the base is mounted on a plurality of Thomson bearings 52, which in turn, slidably engage a pair of rails 53. These rails allow bearings 52, with base 50 mounted thereon, to translate in the plus and minus Y directions. The translation of base assembly 50 is effected through a servo motor 54 turning a ball bearing lead screw 55 linked to base 50 through an internally threaded sleeve 56.

Motor 54 is also controlled by microprocessor-based controller 14 via one of the servo power amplifiers 31. A Y axis encoder 57 measures the movement of base 50 along the Y axis, and feeds this information to the controller to allow it to control the velocity of motor 54 to properly move base 50 during stitching. Y over-travel limit switches 58 limit excessive movment of base 50 along the Y axis.

Stitching module 1 is also provided with a rack assembly 60 for supporting composite workpieces during stitching. This rack assembly is also used to implement movement along the X and gamma axes. Rack assembly 60 includes a stitching rack 61 which conforms in shape to the shape of the workpieces to provide optimum support. For this purpose the stitching rack is molded from fiber glass to the general shape of the workpieces. Thus, workpieces having any shape may be stitched merely by substituting for rack 61 a new rack which conforms to the shape of the new workpieces.

Figure 5:
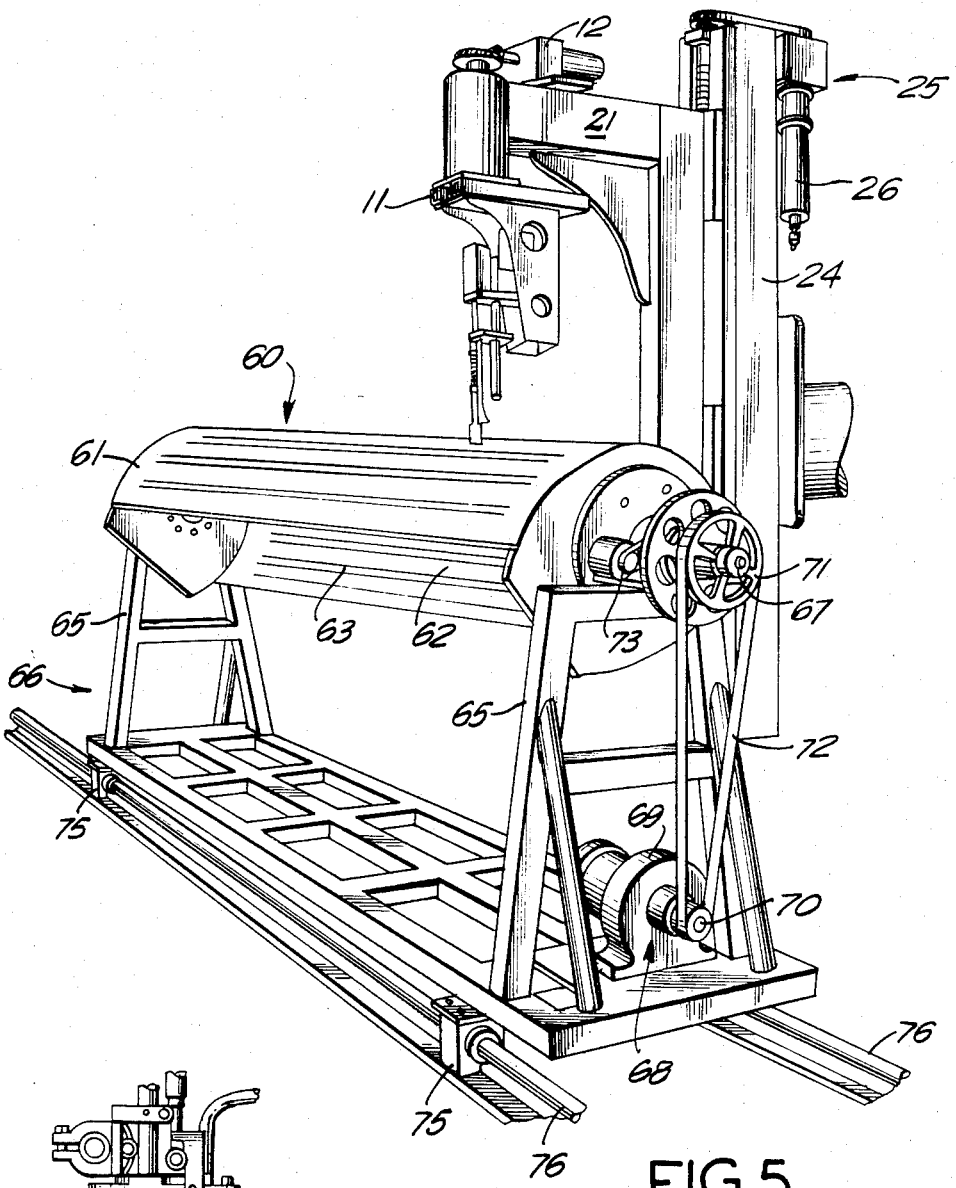
FIG. 5 is a perspective view of the rack assembly showing movement of the rack assembly along the gamma axis.

The construction and operation of rack assembly 60 can best be seen in FIG. 5. The stitching rack 61 shown in FIG. 5 is designed to support an aircraft inlet duct assembly (not shown). In this particular instance its shape is drum-like to accommodate the shape of the inlet duct assembly; however, as noted previously, if a different assembly having a different shape were to be stitched, a new rack conforming to the different assembly would be substituted.

Stitching rack 61 is also supported with transverse stiffening ribs 62 for torsional and lateral strength. On either side of these ribs are clearance slots 63 which are properly spaced to permit needle 9 to penetrate rack 61 during stitching. The bottom of the rack is open to allow access for horn 10 during stitching. The workpieces to be stitched are located on the stitching rack by means of locating pins 64 shown in FIG. 2*a*.

The movement of the stitching module along the X and gamma axes is achieved by appropriately translating and/or rotating rack assembly 60 along such axes.

To allow movement along the gamma axis, rack 61 is rotatably mounted at each end on a support frame 65 of a carriage 66 by means of a shaft and bearing assembly 67. Movement is implemented by means of a gamma axis drive assembly 68 which utilizes a DC servo motor 69 to rotate a pulley wheel 70 fitted to the shaft of motor 69. Pulley wheel 70, in turn, rotates a second pulley wheel 71, fitted to one of the shaft and bearing assemblies 67, by means of a drive belt 72 spanning both pulleys.

Motor 69 is also controlled by controller 14 through one of servo power amplifiers 31. For velocity and position control, gamma axis encoder 73 measures the movement of rack 61 along the gamma axis, after which it transmits such information to the controller.

For movement of rack assembly 60 along the X axis, carriage 66 is mounted on a plurality of Thomson bearings 75 which, in turn, slidably engage a pair of rails 76. Movement is implemented by means of an X axis drive assembly 80 which utilizes a DC servo motor 81 controlled by controller 14 through one of the servo power amplifiers 31. Motor 81 turns a ball bearing lead screw 82 which engages a threaded sleeve 83 attached to carriage 66. As screw 82 is rotated, carriage 66, and ultimately rack assembly 61, are translated in the positive or negative X directions.

Movement by rack assembly 60 along the X axis is measured by an X axis encoder 84, while a pair of over-travel limit switches 85 ensure that such movement does not exceed safe limits. The data measured by the encoder serves as feedback to controller 14 to allow it to properly control the movement of rack 60 during stitching.

It has been discovered that a number of auxiliary mechanisms enhance the module's versatility and speed and improve the quality of its stitch.

Figures 2A, 2B:
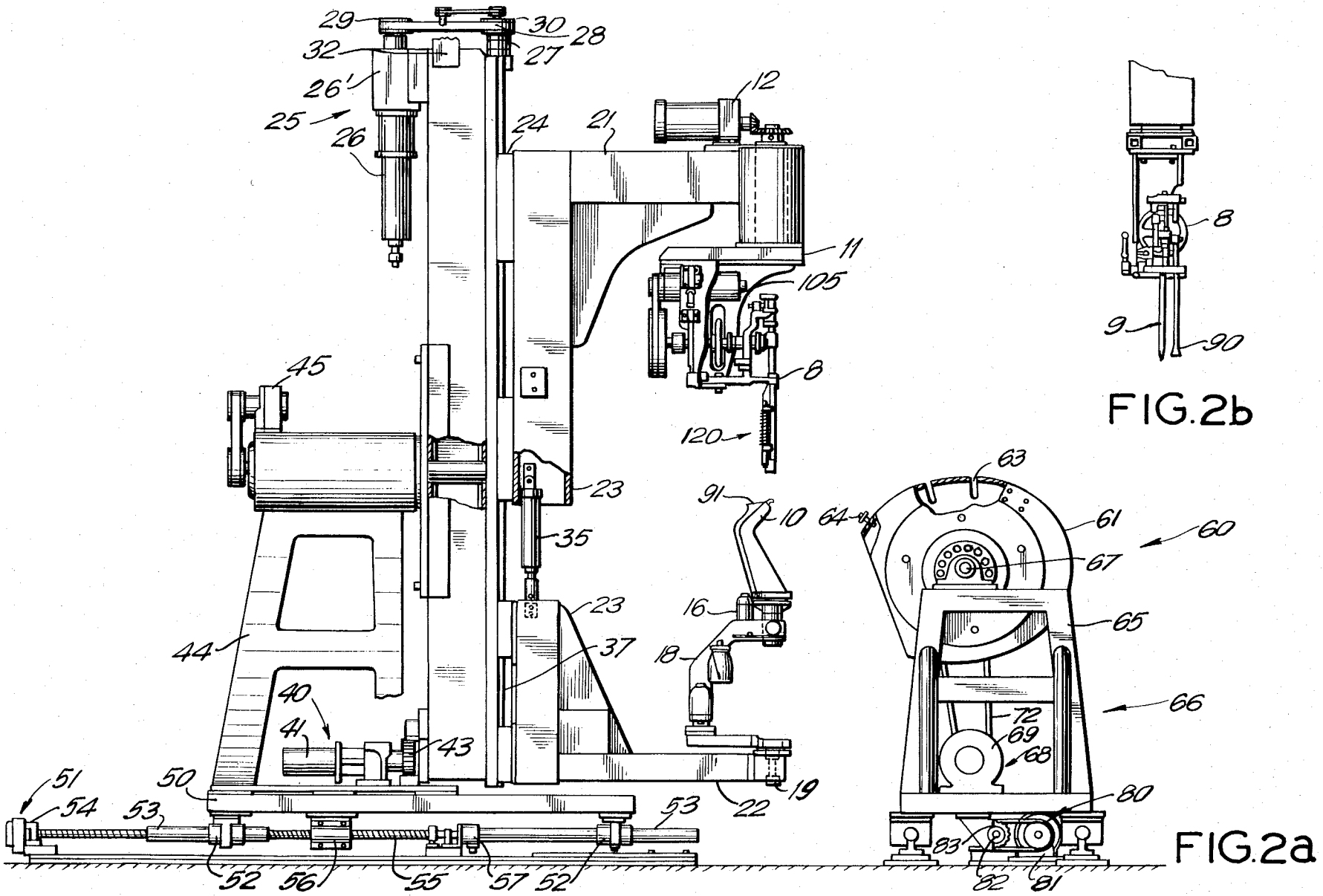
FIG. 2*a* is a side elevational view of the stitching module.
FIG. 2*b* is a front elevational view of the stitching head assembly of the stitching module.

For example, as shown in FIGS. 2*a* and 2*b*, two controllable forced air heaters are provided which permit both top side and bottom side heating of the laminate workpieces being stitched prior to needle entry. For top side heating a tube 90 shown in FIG. 2*b* directs forced hot air to that area of a workpiece at which needle 9 of stitching head assembly 8 is about to penetrate. Tube 90 is mounted on stitching head assembly 8 parallel to needle 9.

For bottom side heating a second tube 91 adjacent to horn assembly 10 is provided. Tube 91 also directs forced hot air to the workpieces, but it is directed to the bottom side of the area where needle 9 is about to penetrate.

The temperature of the hot air directed by tubes 90 and 91 is adjusted so that the workpieces are moderately softened during stitching to minimize fiber breakout in the workpieces and to reduce thread friction and the build-up of resin present in the workpieces on the needle.

Figure 6:
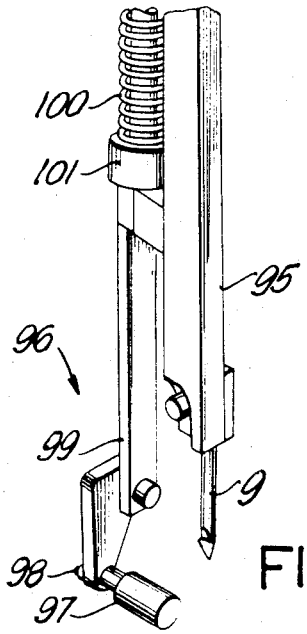
FIG. 6 is an enlarged perspective view of a needle extension arm and a pressure foot roller assembly of the stitching head assembly.

FIG. 6 shows a vertically disposed needle shaft extension 95 which gives stitching module 1 the capability of deep-structure reach during the stitching operation. It is an extension of the needle holder (not shown) of the basic Landis machine, and is connected on one end to such holder. Bolted to the other end is needle 9. The design of needle shaft extension 95 permits the close placement of needle 9 to a workpiece skin being stitched to high standing frame details (e.g., nine inches high), while still allowing stitching module 1 to utilize the needle stroke capabilities inherent in the design of the basic Landis machine.

FIG. 6 also shows a pressure-foot roller assembly 96 used to keep the skin of a workpiece in contact with stitching rack 61 during stitching to aid in the formation of tight stitches. Assembly 96 consists of a pressure roller 97 rotatably mounted on an axis assembly 98 which is bolted to one end of a vertically disposed, spring loaded shaft 99. Shaft 99 is spring loaded by means of a spring 100 which surrounds shaft 99 and is attached thereto by a sleeve 101 which also surrounds shaft 99. The pressure exerted by roller 97 on a given composite workpiece is achieved by microprocessor base controller 14 activating a pressure foot solenoid 102, and in turn, an air cylinder (not shown) attached to the top of shaft 99, so as to cause a vertical displacement downward of shaft 99 and pressure roller 97. Controller 14 is assured that pressure roller 97 is in proper position during stitching by means of a single photo-optical position switch 103. This switch senses whether or not the roller is in the proper extended position for stitching, and transmits this information back to controller 14.

During the stitching operation, roller assembly 96 works in conjunction with the stitching action of needle 9 by holding down the composite materials during the withdrawal of the needle. The roller also aids in the formation of tight stitches by embedding the thread used by the stitching module into the surface of the composite material of the workpieces. Kelvar thread is the type used in the preferred embodiment of the invention.

As noted previously, the twirler and needle assemblies of the basic Landis machine are incorporated in the present invention. However, unlike the arrangement used in the Landis machine where these assemblies are driven by a common shaft and motor, in the stitching module the two assemblies are separated and driven independently by separate DC motors.

Needle 9, which is mounted in stitching head assembly 8, is drivn by a DC servo motor 105 which is part of a servo loop controlled by controller 14 through one of the amplifiers 31. Two photo-optical position switches 106 sense whether needle 9 is in the full-up or full-down position, and transmit this information back to controller 14 for control purposes. Through this control arrangement stitching speeds of one stitch per second, or twenty inches per minute, can be achieved.

For rotation of the twirler (not shown), the mechanism which wraps thread around needle 9 as it penetrates the workpiece, a DC motor 107 is utilized. This motor is also controlled by controller 14, but through motor control logic 15. Four photo-optical position switches 108 positioned at 90° intervals provide controller 14 with the positioning information necessary to control the twirler's operation.

The photo-optical position switches used in stitching module 1 area of typical design, each consisting of a light emitting diode (LED) and a photo transistor. A single shutter, about 0.125 inches wide, is located on each rotating member of the stitching module operating in conjunction with the switches. As these shutters pass sequentially through the LED-photo transistor pairs of the various switches, pulses are generated which are monitored by controller 14 so as to enable it to determine the position of the mechanism being controlled.

Figure 3:
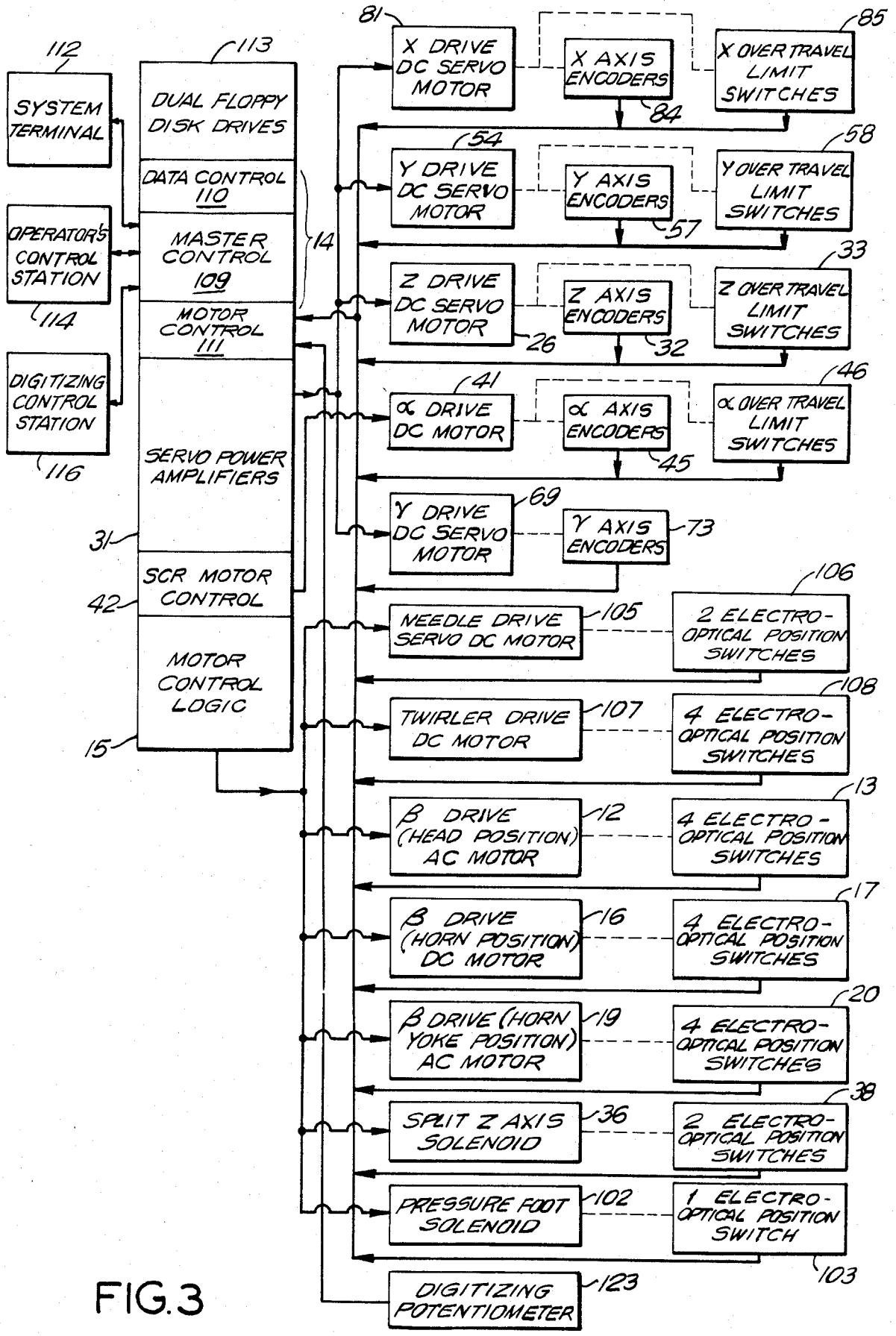
FIG. 3 is an overall block diagram of the stitching module control system.
Figure 4A:
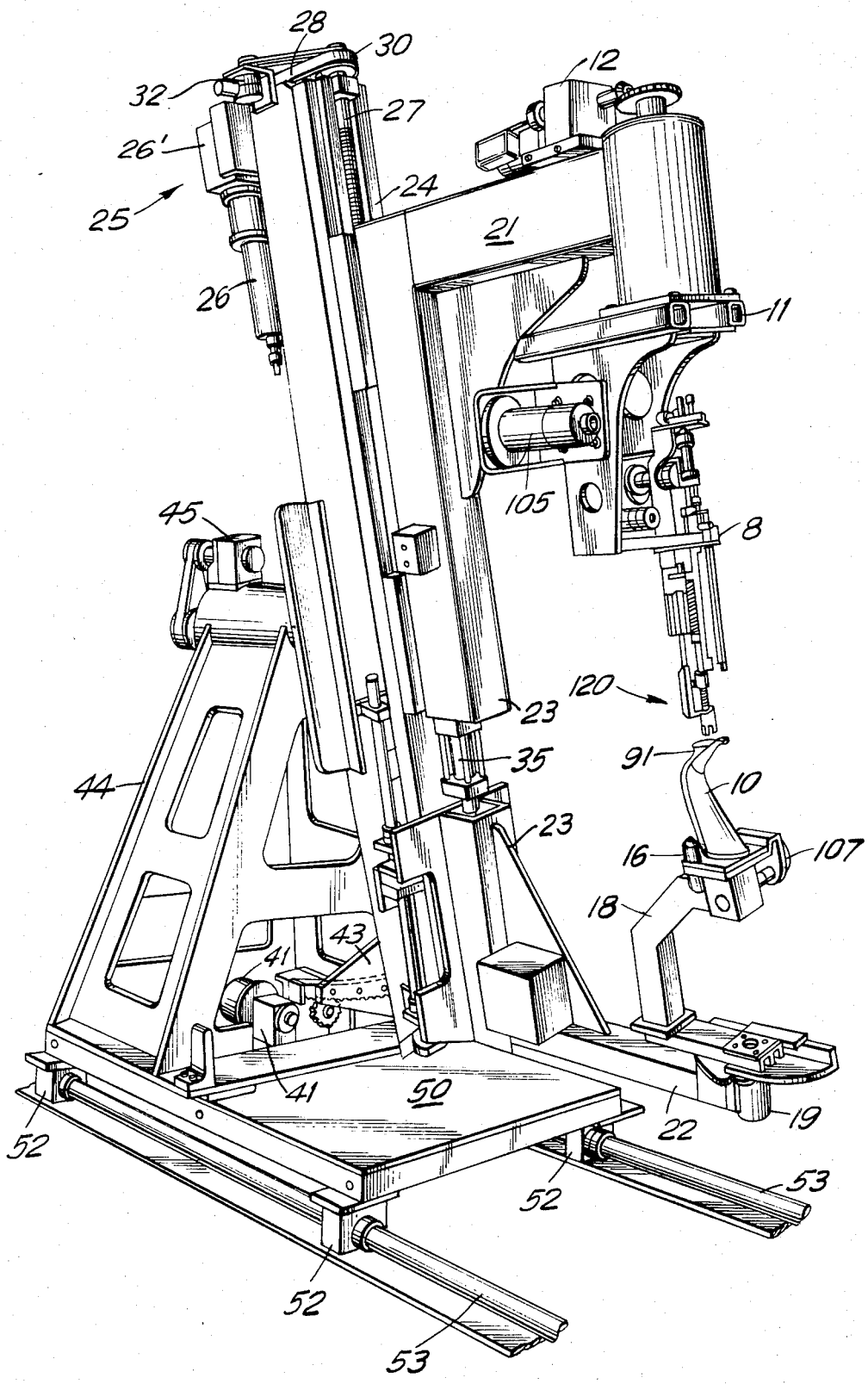
FIG. 4*a* is a perspective view of the stitching module showing motion of the stitching assembly along the alpha axis.
Figure 4B:
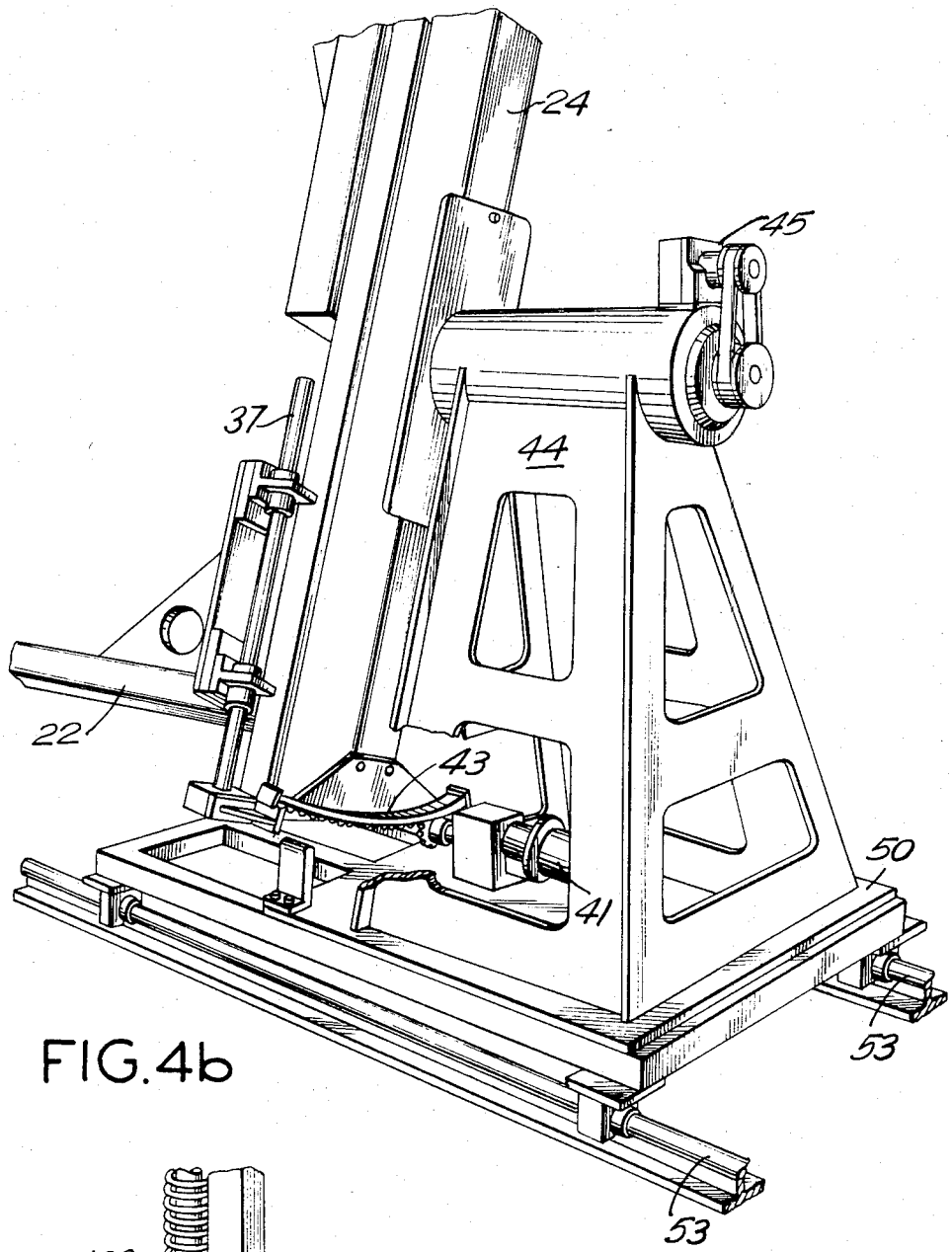
FIG. 4*b* is a partial rear perspective view of the stitching module showing the sector gear used to move the stitching assembly along the alpha axis.

The overall control system of the stitching module is shown in FIG. 3. The heart of the control system is microprocessor-based controller 14. Microprocessor-based controller 14's architecture consists of three single board microcomputers. These microcomputers include a master control microcomputer 109, a data control microcomputer 110 and a motor control microcomputer 111. In the preferred embodiment standard single-board microcomputers, model 80/30 manufactured by Intel Corporation, are used; they employ the Intel 8085 microprocessor and 8K of on-board ROM and 16K of on-board RAM. However, it should be understood that equivalent computers or hard-wired circuits may also be used.

The master control microcomputer 109, which is responsible for supervising the sequence of control of the overall system, allows an operator to interface the control system via a system terminal 112.

The data control microcomputer 110 handles, and processes in real-time during stitching, all of the parts program data which is used to define the stitch paths for the various workpieces. This parts program data is stored on floppy discs mounted in a typical dual floppy disc drive 113. The data, when processed, is passed to the motor control microcomputer 111.

Motor control microcomputer 111 actuates the motors and solenoids used throughout the stitching module. Microcomputer 111 also monitors the photo-optical position and over travel limit switches used throughout the stitching module.

Microprocessor based controller 14 utilizes a bus architecture based upon Intel Corporation's multi-bus multi processor organization. The three microcomputers 109, 110 and 111, the system memory (8K ROM and 32K RAM not shown) and certain peripheral devices, such as the floppy disc, communicate with each other over this system bus. For critical applications, such as monitoring position or limit switches, typical I/O circuit cards, which do not pass data across the system bus but instead are wired directly to the particular microcomputer responsible for such function, are used.

System terminal 112 which is the main operator's interface for access to the control system, is a typical CRT terminal which communicates with the master control microcomputer through a typical interface circuit. In addition to system terminal 112, a small portable remote operator's control station 114 provides an operator with a convenient means of controlling the operation of the system from a remote position. Station 114 communicates with the master control microcomputer through a typical I/O circuit card which does not pass data across the system bus.

The executive operating system software for each microcomputer is located in on-board ROM. In the preferred embodiment this software is a package sold by Intel and is referred to as RMX-80. It can support a multitasking environment, real-time interrupt processing, system terminal communications, inter-task communications and disc file management. Because the functions performed by each microcomputer are different, slightly different versions of this package are used in each of the microcomputers.

Microprocessor based controller 14 is also capable of teaching itself the geometry and auxiliary motions necessary for stitching airplane parts which have not been previously stitched. For this self-digitizing function a digitizing control station 116 is provided to allow the operator to manually jog stitching head 8 along the paths on the workpieces to be stitched. Digitizing control station 116 is constructed with a number of function switches which when activated initiate through controller 14 the various functions associated with carrying out the self-digitizing function. In this mode of operation the stitching head is moved to various desired positions after which a digitizing program of the system operating through data control micro-processor 110 stores the coordinate values measured by the encoders of the X, Y, Z, alpha and gamma axes, and the positional information provided by the position switches of the beta axis and other functions.

Figure 7:
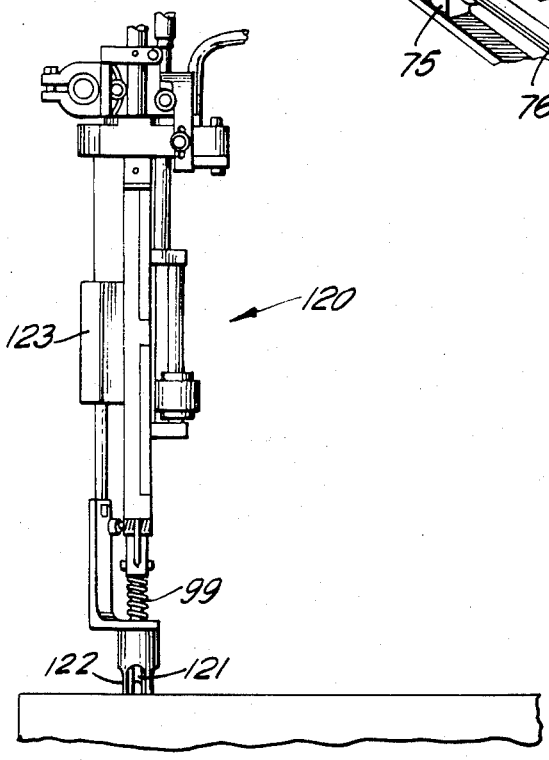
FIG. 7 is a front elevational view of the digitizing adaptor used to program the microprocessor of the control system with new stitching path information.

Referring now to FIG. 7, to help the operator set up the stitching module during the digitizing function a visual aid in the form of a digitizing adaptor 120 is provided. Digitizing adaptor 120 is mounted on the same shaft 99 that mounts pressure roller 97. The adaptor has a pointer 121, attached to the end of shaft 99, which is used by an operator to position the stitching head 8. The adaptor also provides an operator with indications of stitching head normality to the surface of a workpiece and position with respect to the slots 63 of stitching rack 61. This information is used to position the stitching module for the self-digitizing function. The indication of normality is obtained through observing three small feet 122, each the size of a quarter, attached to the bottom of adaptor 120. By positioning all three feet on the surface of a workpiece simultaneously an operator can be reasonably assured that the stitching head is normal to the surface of the workpiece.

To compensate for an operator's positioning inaccuracies, digitizing adaptor 120 is also provided with a potentiometer 123 mounted in the middle thereof. Potentiometer 123 measures the height or elevation of the rack surface with respect to the stitching needle, and thereby provides a Z axis start position above the work surface for needle 9 prior to the start of the stitching operation.

For the digitizing function stitching module 1 is provided with a digitizing program. Through this program an operator is provided with the capability of easily generating new or editing existing part program files.

Figure 8:
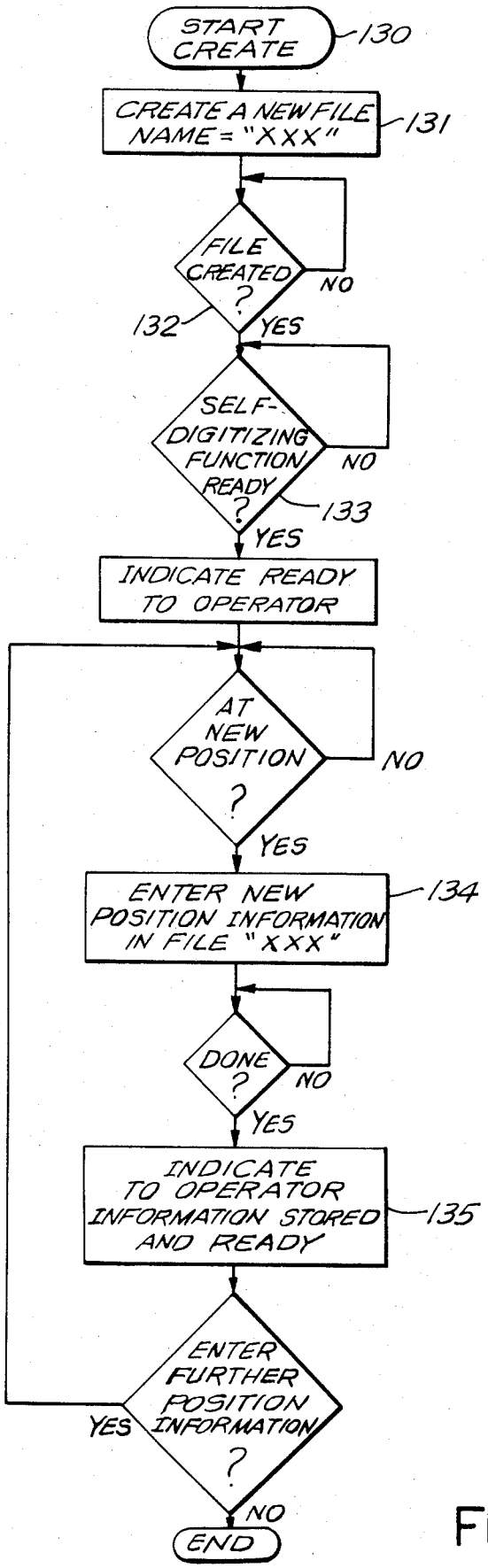
FIG. 8 is a general flowchart of the software routine for creating a new parts program file.

A flowchart showing the general routine followed by the digitizing program in creating a new parts program file is disclosed in FIG. 8. This routine is initiated as indicated at 130 by an operator request via digitizing control station 116 to create a new file. The CRT terminal is used to specify a particular name for the new file. In response to this request the master control microprocessor 109, which coordinates the execution of this routine, commands data control microprocessor 110 to create a new disc file, see 131. The data control microprocessor then creates a new file on one of the floppy discs of drive 113 for storing the parts program file. Thereafter, it informs the master control microprocessor of its completion (see 132). The master control microprocessor 109 then queries motor control microprocessor 111, as shown at 133, as to whether or not it is ready to begin the self-digitizing function. When motor control microprocessor 111 indicates it is ready, the operator manually jogs the coordinate position controlled axes to a new position, or alternatively positions the discrete axis via a manual jog function. When the operator is satisfied with the new position of the system, he commands the system to enter the new system position (see 134) by pressing a switch on control station 116 entitled "Enter Parts Program". The data control microprocessor 110 then enters the new position information into the new program file, after which data control microprocessor 110 indicates to master control microprocessor 109 that the information for that position has been stored and that it is ready to store the next position as shown in the flowchart at 135. At this point the operator can manually jog the system to the next position to be stored and repeat the storage request or he may end the routine.

Figure 9A:
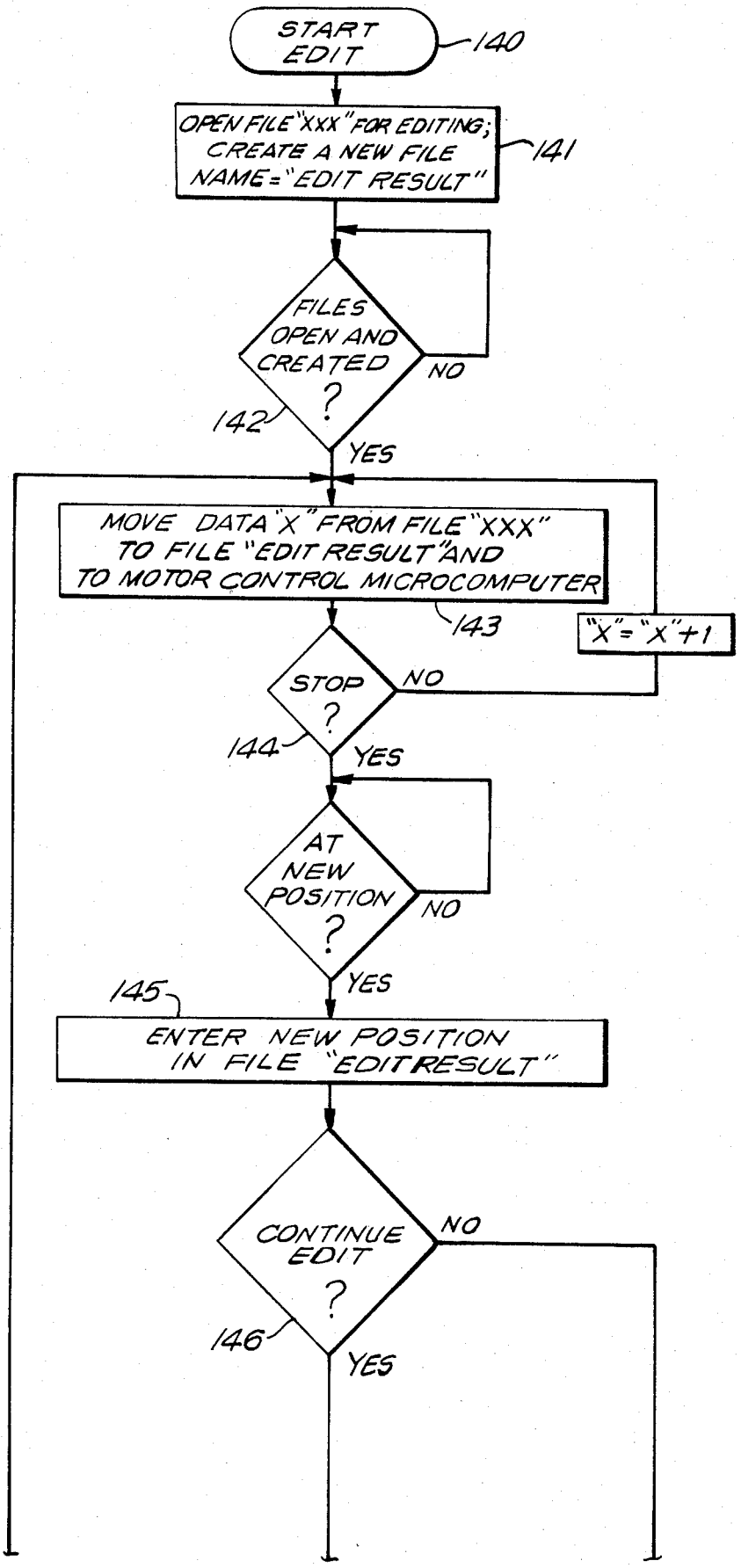
FIGS. 9*a* and 9*b* are a general flowchart of the software routine for editing an existing parts program file.
Figure 9B:
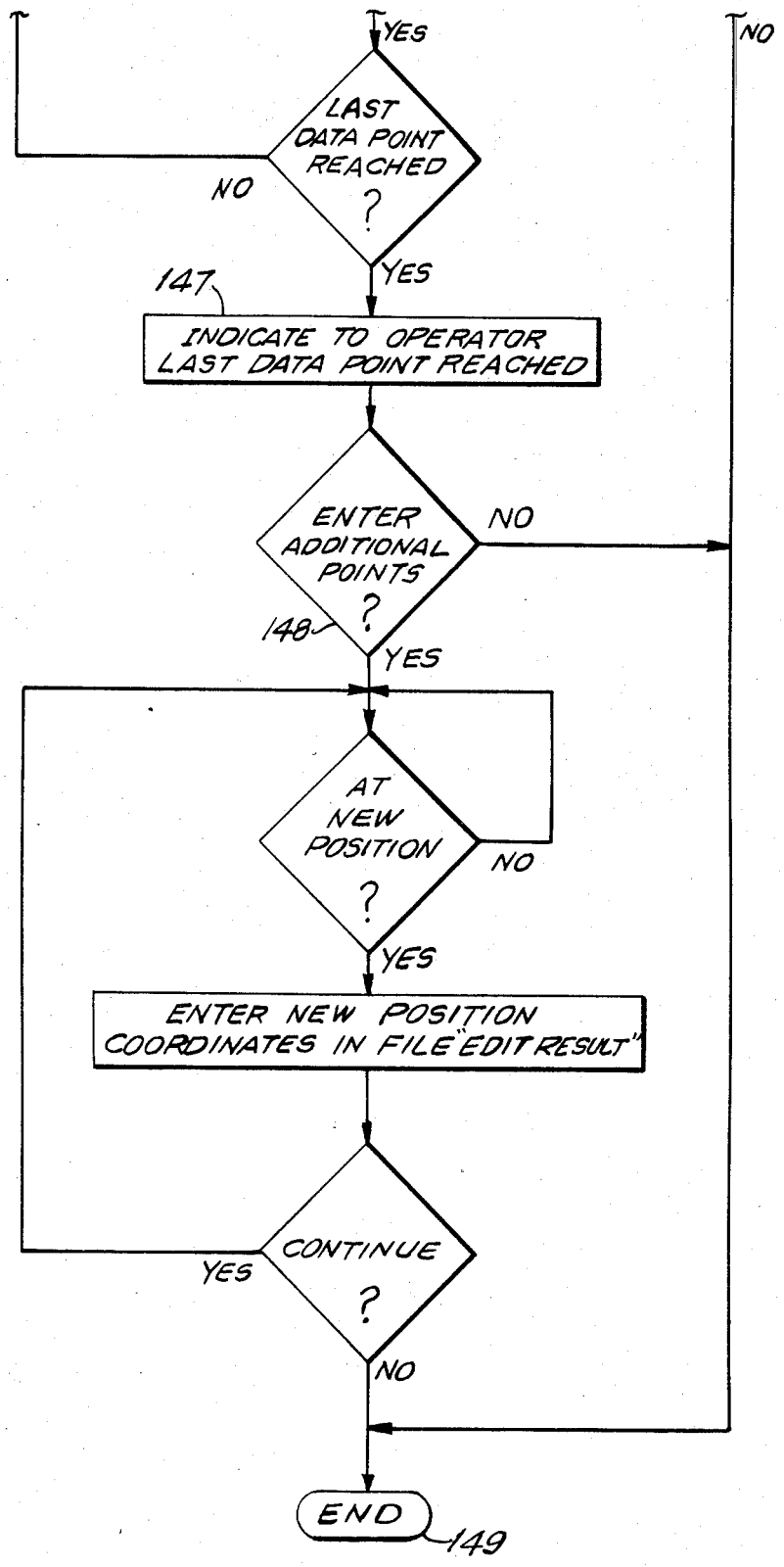

A flowchart showing the general routine followed by the digitizing program in editing an existing parts program file is disclosed in FIGS. 9*a* and 9*b*. This routine is initiated by an operator request via system terminal 112 or control station 114 to edit a particular file (see entry at 140). In response to this request the master control microprocessor 109 commands the data control microprocessor 110 to open the existing disc file for reading and editing, and to create a new file area for the edited resulting file as indicated at 141. Data control microprocessor 110 then signals master control microprocessor 109 that the task is done (see 142). At this point the operator can start playing back the data in the file automatically by pressing a "Start" switch located on the digitizing control station. This causes master control microprocessor 109 to command data control microprocessor 110 to start removing data from the file, and to process and pass it to the motor control microprocessor (see block labled 143). The data controller continues to remove data from the file until it senses a stop command, identified at 144, from the operator issued via microprocessor 109. The operator enters this command when he has reached the point he wishes to edit, and he presses a "Stop" switch also located on control station 116. At this point the operator manually jogs the coordinate position controlled axes to a new position or, alternatively, positions the discrete axis via a manual jog function. Again, when the operator is satisfied with the new position of the system, he presses the "Enter Parts Program" switch on the control station to command the data control microprocessor to enter the new point into the file (see 145). Alternatively, he may remove the data just played back by pressing a "Remove Parts Program" switch on control station 116. Depressing the "Start" switch continues the play back sequence again as indicated at 146 in FIG. 9*a*. When the data control microcomputer reaches the last data point it indicates this to the operator (see 147, FIG. 9*b*). At this point the operator has the option of entering additional points (block 148) or closing the file (149) by pressing an "End" switch on station 116.

During the normal stitching operation the stitching module uses the data stored in a disc file during the digitizing steps described above. The stitching operation includes an automatic switch run wherein each point in a given file is taken out in order by the data control microprocessor 110. If the data is a jog function of a discrete position axis, the operation is performed by motor control microprocessor 111. If it is a position coordinate set, the data control microprocessor 110 does real-time calculations using a linear interpolation procedure to estimate the distance along the switching rack surface from its present position to the new coordinate location. This estimated distance is divided by a pitch length entered during the digitizing sequence. The resulting answer is the number of stitches to be placed between the present position and the next disc file position. The distance to be traveled by each axis is divided by the number of stitches just calculated. This results in an incremental motion requirement for each axis for each stitch. Repetitive application of the incremental values to all of the axes generates the positions of the stitches between the present location and the next digitized value. Using the two types of procedures, i.e., the jog functions for the discrete axis, or the real time stitch path calculations, an entire file is played back under control of the data control microprocessor 110, resulting in a workpiece being stitched according to the data stored in the disc file.

The above described embodiment of the invention is illustrative, and modifications thereof may occur to those skilled in the art. The invention is not limited to the embodiment disclosed herein, but is to be limited only as defined by the appended claims.

What is claimed is:

1. A stitching module for stitching composite laminate workpieces comprising:

(a) means for stitching the workpieces, (b) means for supporting the workpieces during stitching, (c) a plurality of drive means engaging said stitching means for translating and/or rotating said stitching means so that said stitching means can stitch straight and/or contoured paths along the surfaces of the workpieces, and (d) control means connected to said drive means for controlling the operation of said drive means, said plurality of drive means comprising:

(1) means for translating said stitching means along three orthogonal, translational axes, said translating means engaging said stitching means and being connected to said control means; and (2) means for rotating said stitching means along three rotational axes, each of said rotational axes surrounding an axis parallel to one of said translational axes, said rotating means engaging said stitching means and being connected to said control means.

2. A stitching module for stitching composite laminate workpieces comprising:

(a) means for stitching the workpieces, (b) means for supporting the workpieces during stitching, (c) a plurality of drive means engaging said stitching means and said supporting means for translating and/or rotating said stitching means and said supporting means so that said stitching means can stitch straight and/or contoured paths along the surfaces of the workpieces, and (d) control means connected to said drive means for controlling the operation of said drive means, said plurality of drive means comprising:

(1) a first means for translating said stitching means along a first translational axis engaging said stitching means and connected to said control means;

(2) a second means for translating said stitching means along a second translational axis orthogonal to said first translational axis engaging said stitching means and connected to said control means;

(3) a third means for translating said supporting means along a third translational axis orthogonal to said first and second translational axes engaging said support means and connected to said control means;

(4) a first means for rotating said stitching means along a first rotational axis surrounding an axis parallel or equal to said first translational axis engaging said stitching means and connected to said control means;

(5) a second means for rotating said stitching means along a second rotational axis surrounding an axis parallel or equal to said second translational axis engaging said stitching means and connected to said control means;

(6) a third means for rotating said supporting means along a third rotational axis surrounding an axis parallel or equal to said third translational axis engaging said supporting means and connected to said control means.

3. A stitching module as recited in claims 1 or 2 wherein said supporting means comprises a rack shaped to conform to the shape of the workpieces, said rack being replaceable.

4. A stitching module as recited in claims 1 or 2 wherein said stitching means comprises an extended needle shaft for deep structure reach.

5. A stitching module as recited in claim 4 wherein said stitching means further comprises means for heating the workpieces in that area where said extended needle shaft pierces the workpieces.

6. A stitching module as recited in claim 4 wherein said stitching means further comprises means for exerting pressure on the workpieces during stitching in that area where said extended needle shaft pierces the workpieces.

7. A stitching module as recited in claim 6 wherein said pressure exerting means is a pressure foot roller assembly.

8. A stitching module as recited in claims 1 or 2 further comprising self-teaching means attached to said stitching means and connected to said control means, said teaching means providing said control means with stitch path information for workpieces.

9. A stitching module according to claim 8 wherein said self-teaching means comprises:

(a) a digitizing adapter comprising (i) a shaft with a pointer thereon for locating said stitching head with respect to a workpiece, (ii) a plurality of leveling feet attached to said shaft around its circumference for normalizing said stitching head with respect to the surface of the workpiece, and (iii) a potentiometer slidably connected to said pointer for measuring the elevation of said stitching means above the surface of the workpiece, the output of said potentiometer connected to said control means;

(b) means for measuring the location of said stitching means with respect to the workpiece; and (c) means for storing said location measurement and for using said measurement to operate the stitching module.

10. A stitching module according to claims 1 or 2 wherein said control means is a computer.

11. A stitching module for stitching composite laminate workpieces comprising:

a stitching head assembly rotatably mounted to one end of a support, the other end of the support being attached to an upper yoke assembly, said stitching head assembly being engaged by a first rotational drive assembly mounted on said upper yoke assembly for rotating said stitching head assembly along a first rotational axis;

a stitching horn assembly rotatably mounted on a horn yoke assembly rotatably supported by a lower yoke assembly, said stitching horn assembly being engaged by a second rotational drive assembly mounted on said horn yoke assembly for rotating said stitching horn assembly along said first rotational axis, said horn yoke assembly being engaged by a third rotational drive assembly mounted on said lower yoke assembly for rotating said horn yoke assembly along said first rotational axis;

a slide drive assembly on which said upper and lower yoke assemblies are slidably mounted, said upper and lower yoke assemblies being joined together and engaged by a first translational drive mounted on said slide drive assembly for translating said upper and lower yoke assemblies along a first translational axis;

a base assembly to which said slide drive assembly is rotatably mounted, said slide drive assembly being engaged by a fourth rotational drive mounted within said base assembly for rotating said slide drive assembly, and thereby said stitching head and horn assemblies along a second rotational axis, said base assembly being slidably mounted on a first pair of rails through a first plurality of bearing assemblies and engaged by a second translational drive for translating said base assembly and thereby said stitching head and horn assemblies, along a second translational axis orthogonal to said first rotational axis;

a rack assembly comprising a rack rotatably mounted on a carriage, said rack being engaged by a fifth rotational drive mounted on said carriage for rotating said rack along a third rotational axis, said carriage being slidably mounted on a second pair of rails through a second plurality of bearing assemblies, and engaged by a third translational drive for translating said carriage and thereby said rack, along a third translational axis orthogonal to said first and second translational axis; and a microprocessor based control system for operating said drives in accordance with at least one stored parts file.

12. A stitching module according to claim 11 wherein said rack is shaped according to the shape of the workpieces and replaceable.

13. A stitching module according to claim 11 wherein said stitching head assembly comprises:

(a) an extended needle shaft for deep structure reach;

(b) a pressure foot for exerting pressure on the workpieces in the area where said needle shaft penetrates the workpieces, and (c) at least one tube for directing heat to the workpieces in the area where said needle shaft for deep structure reach;

(b) a pressure foot for exerting pressure on the workpieces in the area where said needle shaft penetrates the workpieces, and (c) at least one tube for directing heat to the workpieces in the area where said needle shaft penetrates the workpieces.

14. A stitching module according to claim 11 further comprising a digitizing adapter for positioning said stitching head assembly comprising:

(a) a shaft with a pointer for locating said stitching head assembly with respect to the workpieces, (b) a plurality of feet surrounding said shaft for normalizing said stitching head assembly with respect to the surface of the workpieces, and (c) a potentiometer slidably attached to said pointer to measure the elevation of said stitching head assembly above the workpieces.

15. A stitching module for stitching composite laminate workpieces comprising:

(a) means for stitching the workpieces, (b) means for supporting the workpieces during stitching, (c) a plurality of drive means engaging said stitching means for translating and/or rotating said stitching means so that said stitching means can stitch straight and/or contoured paths along the surfaces of the workpieces, (d) control means connected to said drive means for controlling the operation of said drive means, and (e) self-teaching means attached to said stitching means and connected to said control means, said self-teaching means providing said control means with stitch path information for workpieces and comprising:

(1) A digitizing adapter comprising:

(i) a shaft with a pointer thereon for locating said stitching head with respect to a workpiece, (ii) a plurality of leveling feet attached to said shaft around its circumference for normalizing said stitching head with respect to the surface of the workpiece, and (iii) a potentiometer slidably connected to said pointer for measuring the elevation of said stitching means above the surface of the workpiece, the output of said potentiometer connected to said control means;

(2) means for measuring the location of said stitching means with respect to the workpiece; and (3) means for storing said location measurement and for using said measurment to operate the stitching module.

16. A stitching module for stitching composite laminate workpieces comprising:

(a) means for stitching the workpieces, (b) means for supporting the workpieces during stitching, (c) a plurality of drive means engaging said stitching means and said supporting means for translating and/or rotating said stitching means and said supporting means so that said stitching means can stitch straight and/or contoured paths along the surfaces of the workpieces, and (d) control means connected to said drive means for controlling the operation of said drive means, and (e) self-teaching means attached to said sttiching means and connected to said control means, said teaching means providing said control means with stitch path information for workpieces and comprising:

(1) a digitizing adapter comprising:

(i) a shaft with a pointer thereon for locating said stitching head with respect to a workpiece, (ii) a plurality of leveling feet attached to said shaft around its circumference for normalizing said stitching head with respect to the surface of the workpiece, and (iii) a potentiometer slidably connected to said pointer for measuring the elevation of said stitching means above the surface of the workpiece, the output of said potentiometer connected to said control means;

(2) means for measuring the location of said stitching means with respect to the workpiece; and (3) means for storing said location measurement and for using said measurement to operate the stitching module.

* * * * *

UNITED STATES PATENT AND TRADEMARK OFFICE

CERTIFICATE OF CORRECTION

PATENT NO. : 4,503,788

DATED : March 12, 1985

INVENTOR(S) : Ottavio Giannuzzi et al

It is certified that error appears in the above-identified patent and that said Letters Patent is hereby corrected as shown below:

In column 1, line 16, "genertion" should read -- generation --.

In column 4, line 7, "26" should read -- 26' --.

In column 10, line 42, "switching" should read -- stitching --; line 46, "resulting" should read -- resultant --.

In column 14, Claim 16, line 41, "sttiching" should read -- stitching --.

Signed and Sealed this

*Fifteenth* Day of *October 1985*

[SEAL]

*Attest:*

*Attesting Officer*

DONALD J. QUIGG

*Commissioner of Patents and Trademarks—Designate*